United States Patent [19]

Shay

[11] Patent Number: 4,669,665

[45] Date of Patent: Jun. 2, 1987

[54] NOZZLE

[75] Inventor: Joseph J. Shay, Waterbury, Conn.

[73] Assignee: Specialty Packaging Licensing Company, Wilmington, Del.

[21] Appl. No.: 659,684

[22] Filed: Oct. 11, 1984

[51] Int. Cl.[4] ..... B05B 1/26

[52] U.S. Cl. ..... 239/428.5; 239/463; 239/518

[58] Field of Search ..... 239/491–497, 239/461, 463, 428.5, 518, 499, 467, 333, 343

[56] References Cited

U.S. PATENT DOCUMENTS

| | | | |
|---|---|---|---|
| 1,620,209 | 3/1927 | Ihne | 239/497 |
| 2,218,189 | 10/1940 | Allen | 239/499 X |
| 2,250,079 | 7/1941 | McDonald | 239/496 |
| 2,378,348 | 6/1945 | Wilmes et al. | 239/491 |
| 2,603,469 | 7/1952 | Bedford et al. | 239/428.5 X |
| 3,236,458 | 2/1966 | Ramis | 239/338 |
| 3,369,756 | 2/1968 | Ramis | 239/498 |
| 3,836,076 | 9/1974 | Conrad et al. | 239/428.5 X |
| 4,313,568 | 2/1982 | Shay | 239/494 |

*Primary Examiner*—Jeffrey V. Nase

*Attorney, Agent, or Firm*—Edgar E. Spielman, Jr.

[57] ABSTRACT

This invention relates to a nozzle for dispensing and aerating liquids. The nozzle provides for the formation of a substantially hollow conical vortex which aspirates air into its interior. The vortex is formed within a chamber so that the base of the vortex impinges upon the chamber walls. This impingment results in the formation of a turbulent film which, when brought in contact with the aspirated air, results in aeration of the liquid forming the film. A foam like characteristic is given the liquid by the entrapment of the air as the liquid is dispensed.

9 Claims, 7 Drawing Figures

NOZZLE

BACKGROUND OF THE INVENTION

In the packaging of many liquid household products, e.g., window cleaners, insect poisons cleaning fluids, etc., it has been found market-attractive to include, as part of the package, a finger actuated dispensing pump. These pumps are generally fitted with nozzles which are capable of product delivery in a spray mode and/or a stream mode. Most nozzles produce the spray mode by causing the liquid product to be broken up into small particles as it is dispensed from the nozzle. This breaking up of the liquid is generally accomplished by forcing the liquid to traverse a swirling path as it exits the nozzle outlet orifice. The swirling path can be accomplished by the use of any of the well known "swirl chamber" devices which are associated with the nozzle. See for example the devices of U.S. Pat. Nos. 4,358,057; 4,257,751; and 4,161,288.

The spray mode of delivery is preferred over the stream mode in those applications where the product is to be applied evenly over a relatively large area. However, due to the break-up of the liquid, some of the product will be delivered as a fine mist. Also a fine mist can be formed when the product impacts the surface on which it is sprayed. When the product is applied in an enclosed area, e.g. a shower stall, there is the possibility that the user will inhale some of the mist. Even in open areas the mist is apt to settle where not desired, e.g. the users wearing apparel. When the product is toxic or corrosive this inhalation and settling is undersirable if not blatantly dangerous.

To overcome the problems created by the fine mist, the pump industry has tried aeration of the small liquid particles subsequent to their exiting the swirl chamber. Such aeration gives at least a portion of the dispensed liquid a foam characteristic which does not yield the unwanted fine mist—indeed the foamed liquid is further beneficient in that it entraps any fine mist which comes into contact with it. Aeration of the small liquid particles is conventionally achieved by providing an open ended chamber which surrounds and extends outwardly of the nozzle outlet orifice and which has aspirating ports generally located between the nozzle outlet orifice and the open end of the chamber. More specifically, it has heretofore been assumed that these aspiration ports should be located between the nozzle outlet orifice and the back-side of the cone shaped spray pattern. (The formation of the cone pattern is a well recognized characteristic of swirl chambers). While the use of the chamber with its aspiration ports does provide aeration by entrapment of aspirated air, this system is not without a major drawback. To obtain proper aeration the aspiration ports must remain open. However, due to the close proximity of the ports to the dispensed liquid, the ports may become at least partially filled with the dispensed liquid. Such liquid, when it dries, could lead to clogging of the ports. With the aspiration ports partially or completely clogged proper aeration can be compromised.

It is therefore an object of this invention to provide a nozzle which provides for aeration of a liquid product that is dispensed through a swirl chamber without the utilization of the above described aspiration ports.

THE INVENTION

This invention relates to a nozzle for aerating and dispensing a liquid. The aeration of the liquid gives the liquid a foam characteristic. The nozzle of this invention is suitable for use with any of the type of dispensing systems which can deliver the liquid under pressure to the nozzle. Exemplary of such systems are aerosal systems, trigger actuated pumps, finger actuated pumps and the like. The nozzles can be mounted to the dispensing stems or to the bore barrels as the case may be for any particular dispensing system.

More particularly, the nozzle of this invention includes a passage way through which the liquid to be dispensed can pass to the nozzle while under pressure. The nozzle also includes a mechanical break-up structure, e.g. swirl chamber, which is located in between and in liquid communication with the passage way and a nozzle outlet orifice. The mechanical break-up structure causes the pressurized liquid communicated to it to be dispensed through the nozzle outlet orifice as a swirling conical sheet having sufficient angular velocity to form a substantially hollow conical vortex. The vortex will provide, at its interior, a pressure which is lower than ambient pressure. This lower pressure results in air being aspirated into the interior of the vortex. The greater the difference between the ambient pressure and the internal vortex pressure, the greater the amount of air that will be aspirated into the vortex interior. Since the availability of air is at least partially responsible for the amount of aeration achieved, the amount of foaming of the dispensed liquid is directly affected by the strength of the vortex. Achieving the desired vortex strength is an empirical science and depends upon the pressure under which the liquid is delivered to the nozzle, the design of the mechanical break-up structure and the physical characteristics of the liquid being dispensed.

Also, affecting the degree of aeration of the dispensed liquid is an elongated chamber which is part of the nozzle of this invention. This chamber, at its proximate end, surrounds the nozzle outlet bore. At its distal end the elongated chamber has an open mouth through which the dispensed liquid will ultimately be delivered for use. The remainder of the elongated chamber is closed which is unlike prior art devices which utilize the before described aspiration ports. The elongated chamber affects aeration because it is dimensioned and configured so that the substantially hollow conical vortex is wholly formed therein and so that the chamber wall(s) intercept the vortex at its base to produce a turbulent liquid film on the wall(s). This turbulent film is highly susceptible to aeration from the air which is being aspirated into the interior of the vortex. It has been found that the longer the turbulent film is exposed to the aspirated air the greater the aeration of the dispensed liquid and thus the greater its foam characteristic. This time of exposure is easily controlled by dimensioning the length of the elongated chamber. As is the case in determining suitable vortex strength, the determination of optimal elongated chamber length is an empirical science. Factors affecting suitable length are the amount of available aspirated air and the physical characteristics of the liquid e.g. surface tension, viscosity, etc. It should be noted, however, that the elongated chamber should not be of excessive length as the aerated liquid may not be dispensed from the elongated chamber with a force sufficient to satisfy the user's purposes. Generally speaking, elongated chambers having a length within the range of from about 0.100 to about 0.600 inches and a diameter within the range from about 0.100 to about 0.400 inches are suitable for use with most liquid products. For most commercial applications a preferred elongated chamber will have a length within the range from about 0.150 to about 0.200 inches and a diameter within the range from about 0.135 to about 0.170 inches.

To provide a highly suitable vortex, it has been found that the mechanical break-up structure is preferably of the swirl chamber type. The vortex formation by conventional swirl chambers is well known to those skilled in the art. Any of the swirl chamber configurations presently in the market place or disclosed in printed publications are suitable so long as they are capable of forming the before mentioned hollow conical vortex.

The nozzle of this invention can be conveniently formed by injection molding thermoplastic materials such as polypropylene, polyethylene, polyethylene terephthalate, etc.

As can be seen from the above description, the nozzle of this invention does not utilize aspiration ports in the elongated chamber as is the case for prior art nozzles. In fact, the elongated chamber is closed throughout its extent except for the open mouth at its distal end. Thus, the nozzle of this invention is not nearly as prone to aeration failure due to blockage of the path required for the aspirated air.

These and other features of this invention contributing to satisfaction in use and economy in manufacture will be more fully understood from the following description of preferred embodiments of this invention and the accompanying drawings in which.

Figure 1:
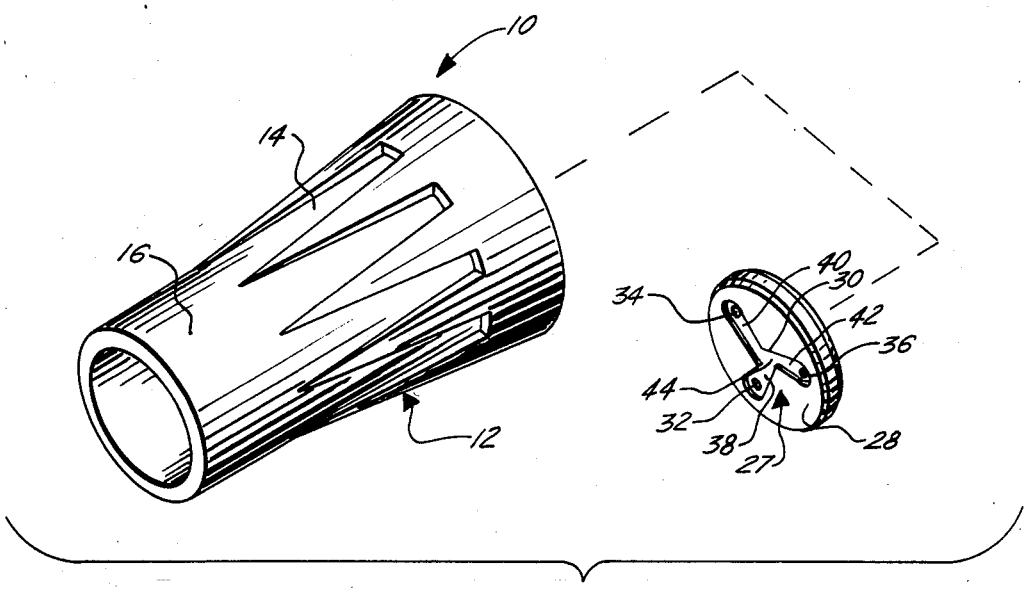
FIG. 1 is a exploded view of a nozzle of this invention.
Figure 2:
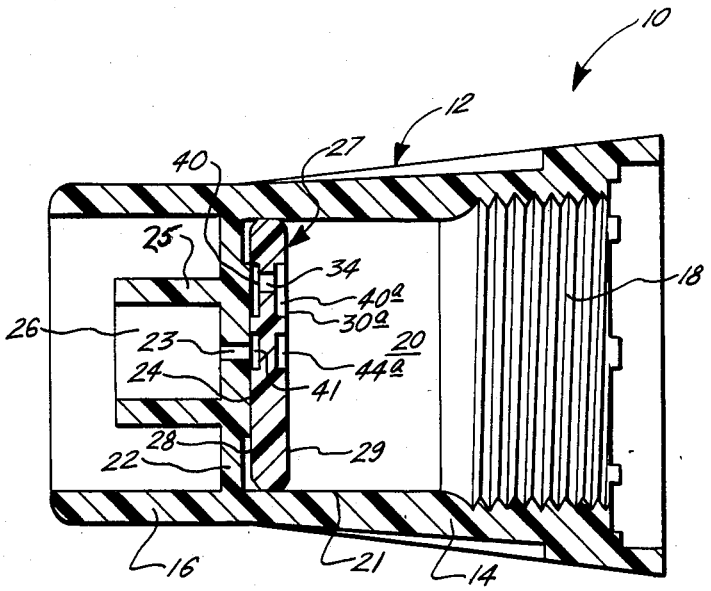
FIG. 2 is a sectional view of the nozzle shown in FIG. 1.

Referring now to FIGS. 1 and 2, there can be seen a nozzle of this invention, generally designated by the numeral 10 which includes a nozzle skirt 12 and a swirl chamber button 27. The nozzle skirt 12 has a frusto-conical portion 14 and a cylindrical portion 16. As is shown in FIG. 2, there is helical thread 18 about the inside wall of the proximate end of frusto-conical portion 14. Helical thread 18 is for threaded cooperation with a complimentary thread found about the terminal end of a bore barrel of the type shown in U.S. Pat. No. 4,161,288. Just forward of helical thread 18 is liquid passage 20. Liquid passage 20 will be filled with pressurized liquid which is fed through the bore of the pumping device.

At the distal end of liquid passage 20 is wall 22. Note that wall 22 has a planar surface 24 which faces into liquid passage 20. On the opposite side of wall 22 there is provided open ended cylinder 25 which is coaxially located with respect to nozzle exit orifice 23 which traverses wall 22. Open ended cylinder 25 defines chamber 26. Defining an annular space about open ended cylinder 25 is the inside wall of cylindrical portion 16.

As can be seen in FIG. 2, wall 22, open ended cylinder 25 and the nozzle skirt can be integrally formed as one piece.

To effect the formation of a vortex comprised of the swirling conical sheet formed of the liquid to be dispensed, there is provided swirl chamber button 27. For the embodiment shown in FIGS. 1 and 2 the swirl chamber button is a second piece of nozzle 10. Button 27 is dimensioned to have a diameter so that it can be snuggledly nest within liquid passage 20 as shown in FIG. 2. Swirl chamber button 27 has at least one planar face 28. Within planar face 28 is swirl chamber cavity 30 which is comprised of swirl chamber arms 38, 40 and 42 which are tangentially located with respect to center portion 44. The configuration of swirl chamber cavity 30 is conventional and is not critical to the operation of the nozzle of this invention so long as it provides the necessary vortex. To communicate liquid from liquid passage 20 to swirl chamber cavity 30 there is provided at the outmost extent of swirl chamber arms 38, 40 and 42 entrance ports 32, 34 and 36 respectively. As can be seen in FIG. 2 when swirl chamber cavity 30 achieves an abutting relationship with planar surface 24 a swirl chamber is created. Liquid entering into this formed swirl chamber under pressure will be required to take a swirling path which effects the formation of the desired vortex. Note further that in FIG. 2 that nozzle exit orifice 23 is located to overlie center portion 44 of swirl chamber cavity 30. It is from center portion 44 that the swirled liquid will exit through nozzle exit orifice 23.

It is desirable, from an assembly point of view, that swirl chamber button 27 have an additional planar face 29. Planar face 29 has its own swirl chamber cavity **30*a*. As seen in FIG. 2, swirl chamber cavity 30*a* is identical to swirl chamber cavity 30. Showing this similarity between the two swirl chamber cavities are swirl chamber arm 40*a* and center portion 44*a*. It is to be understood that the other portions of swirl chamber cavity 30*a* which are not shown are identical in shape, dimension etc. as the ones comprising swirl chamber cavity 30. The advantage of providing swirl chamber button 27 with identical swirl chambers on its opposite faces is that the swirl chamber button can be readily assembled within nozzle skirt 12 without regard to which side of the button is placed in abuttment with planar surface 24**.

Figure 3:
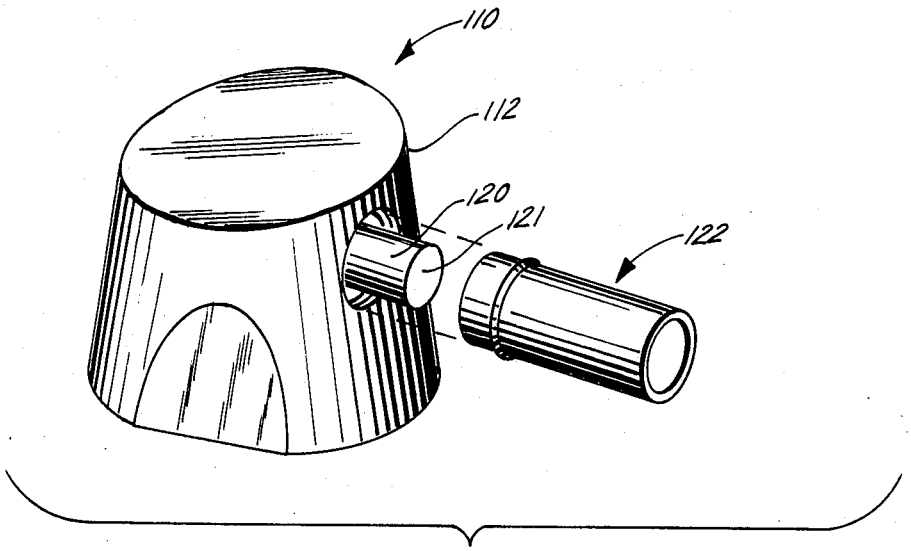
FIG. 3 is an exploded view of another nozzle of this invention.
Figure 4:
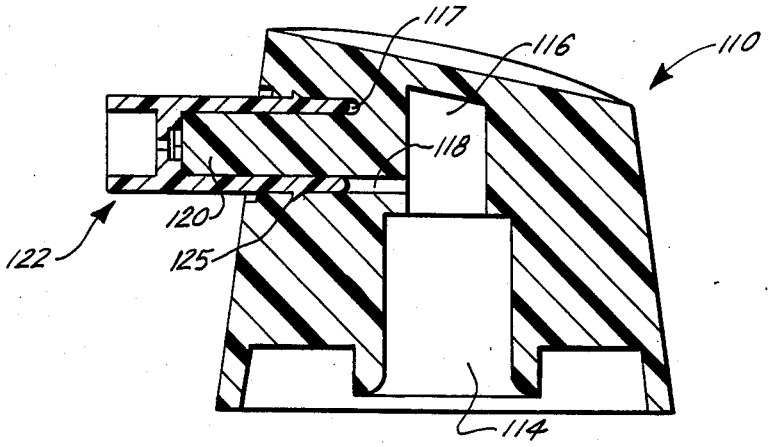
FIG. 4 is a sectional view of the nozzle shown in FIG. 3.
Figure 5:
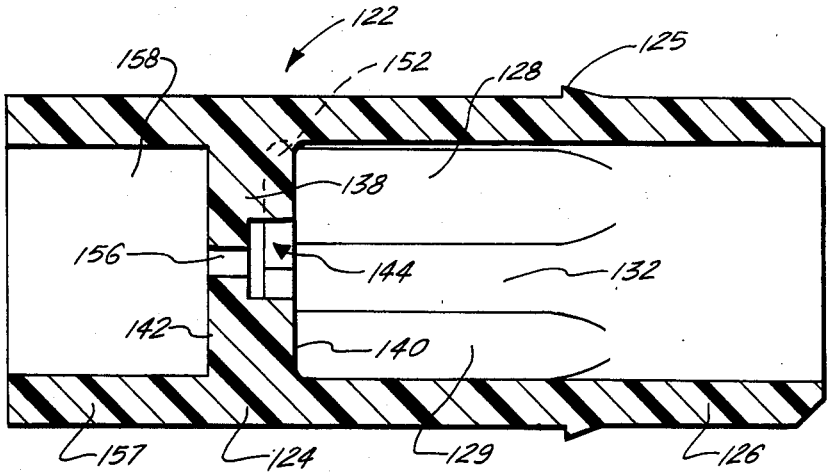
FIG. 5 is a sectional view of the nozzle cylinder shown in FIG. 3.

Another embodiment of this invention is shown in FIGS. 3–6. As can be seen in FIGS. 3 and 4, nozzle 110 has a body, generally designated by the numeral 112 and a nozzle cylinder, generally designated by the numeral 122. Body 112 has a mounting cavity 114 which is dimensioned to achieve a tight fit with the dispensing stem of a finger actuated pumping system. Immediately above and in liquid communication with mounting cavity 114 is liquid passage 116. Cut into body 112 is an annular recess 117. Annular recess 117 is dimensioned so that the proximate end of cylindrical body portion 124 of nozzle cylinder 122 can be fitted therein as shown in FIG. 4. As can also be seen in FIG. 4, at least a portion of annular recess 117 extends into and achieves liquid communication with liquid passage 116. This extended portion is designated by the numeral 118. Coaxially located within annular recess 117 is mounting post 120. Mounting post 120 terminates in a planar face 121.

The nozzle cylinder 122 has a cylindrical body portion 124. Located about the proximate portion 126 of cylindrical body portion 124 is annular protuberance 125. Annular protuberance 125 assures a snug fit of proximate portion 126 within annular recess 117 as is shown in FIG. 4. Proximate portion 126 has a cylindrical interior wall which carrys four spaced apart protuberances 128, 129, 130 and 131. The portions of the cylindrical wall located between these protuberances will form liquid passage-ways when nozzle cylinder 122 is mounted within annular recess 117 so as to surround mounting post 120. The protuberances provide a frictional fit with mounting post 120 to aid in holding nozzle cylinder 122 in position.

Figure 6:
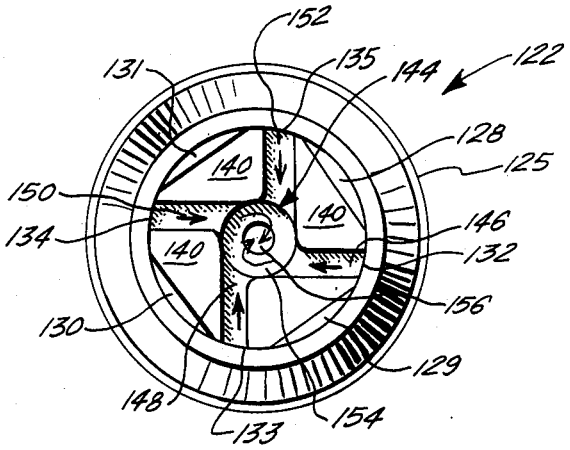
FIG. 6 is an end of view of the nozzle cylinder shown in FIG. 3.

Separating proximate portion 126 from distal portion 157 is circular wall 138. Circular wall 138 has an inside planar face 140 and outside planar face 142. As can be seen in FIG. 6 inside planar face 140 has a swirl chamber cavity 144 cut therein. Swirl chamber cavity 144 is of conventional construction and features swirl chamber arms 146, 148, 150 and 152 which are in tangential relationship with circular center portion 154. Note that the swirl chamber arms are located so as to be in liquid communication with liquid passage ways 132, 133, 134 and 135 respectively. Circular center portion 154 is in liquid communication with nozzle exit orifice 156. Nozzle exit orifice 156 is coaxial with and surrounded by a cylindrical chamber 158 which is defined by a cylindrical inside wall which is provided by distal portion 157.

When nozzle cylinder 122 is mounted to mounting post 120 the planar face 121 of mounting post 120 will be in abuttment with swirl chamber cavity 144 thereby providing a swirl chamber. Upon provision of liquid under pressure to liquid passage 116 it can be seen that such liquid will travel to extended portion 118 of annular recess 117. This liquid will then be routed along liquid passage-ways 132, 133, 134 and 135 to the arms 146, 148, 150 and 152 of the swirl chamber provided by swirl chamber cavity 144 and planar face 121. As is shown in FIG. 6 this liquid under pressure will be required to follow a path giving it a swirling action so that it is dispensed through nozzle exit orifice 156 to form a hollow conical vortex.

The dimensions, both diameter and length, of chamber 26 for the nozzle of FIGS. 1 and 2 and of chamber 158 for the nozzle of FIGS. 3–6 are such that the base of the formed vortex will be intercepted by the inside cylindrical wall(s) defining the chambers. This interception results in the formation of a turbulent film which entraps air drawn in by the formed vortex.

Figure 7:
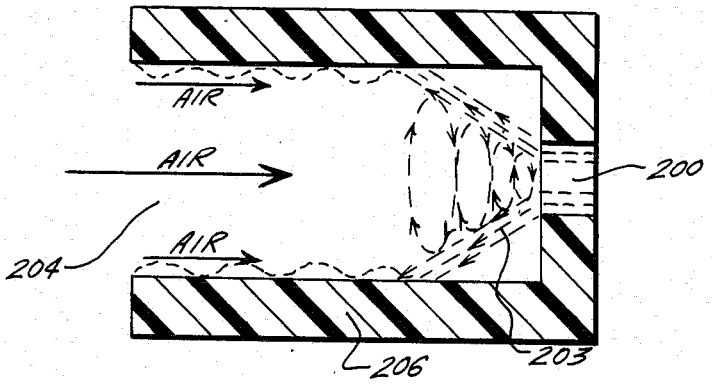
FIG. 7 is a schematic view of the vortex formed in the nozzle cylinder.

FIG. 7 schematically shows the action of the vortex, the aspiration of air and the aeration of the dispensed liquid. As can be seen, liquid which has been forced through a mechanical break-up device, e.g. a swirl chamber, exits nozzle orifice 200. As required, the mechanical break-up structure causes the liquid to form a substantially hollow conical vortex 203 which is made of the liquid to be dispensed. As shown in the Figure, the base of the vortex collides with the inner wall of chamber 204 thereby resulting in the formation of a turbulent liquid film 206. Hollow cylindrical vortex 203 causes air to be aspirated towards its center and such air comes in contact with the formed turbulent film. This contact results in entrapment of the air within the film resulting in aeration of the liquid. As mentioned previously, the longer the air contact is maintained, the more aeration is achieved.

I claim:

1. A nozzle for aerating and dispensing a liquid, which nozzle comprises:

(a) a passage means through which the liquid to be dispensed can pass while under pressure;

(b) a mechanical break-up means located in between and in liquid communication with said passage means and a nozzle outlet orifice, said mechanical break-up means causing at least a portion of the liquid communicated to it through said passage means to be dispensed through said nozzle outlet orifice as a swirling conical sheet having sufficient angular velocity to form a substantially hollow concial vortex, which vortex aspirates air into its interior;

(c) an elongated chamber in which said vortex is formed, said chamber, having a permanently closed proximate end surrounding said nozzle outlet orifice, an open distal end and a permanently closed wall connecting said closed proximate end and said open distal end so that air can only be aspirated through said open distal end and said wall intercepts said substantially hollow conical vortex at its base whereby a turbulent film of said liquid is formed on said wall and said aspirated air aerates said liquid which forms said turbulent film.

2. The nozzle of claim 1 wherein said mechanical break-up means is a swirl chamber.

3. The nozzle of claim 1 wherein said elongated chamber is cylindrical.

4. The nozzle of claim 3 wherein said elongated chamber has a length within the range from about 0.100 to about 0.600 inches and a diameter within the range from about 0.100 to about 0.400 inches.

5. The nozzle of claim 3 wherein said elongated chamber has a length within the range from about 0.150 to about 0.200 inches and a diameter within a range from about 0.135 to about 0.170 inches.

6. The nozzle of claim 3 wherein said elongated chamber is coaxial with said nozzle outlet bore.

7. The nozzle of claim 6 wherein said elongated chamber has a length within the range from about 0.100 to about 0.600 inches and a diameter within the range from about 0.100 to about 0.400 inches.

8. The nozzle of claim 6 wherein said elongated chamber has a length within the range from about 0.150 to about 0.200 inches and a diameter within a range from about 0.135 to about 0.170 inches.

9. The nozzle of claim 8 wherein said mechanical break-up means is a swirl chamber.

* * * * *